US005322469A

United States Patent [19]

Tilbor

[11] Patent Number: 5,322,469

[45] Date of Patent: Jun. 21, 1994

[54] VEHICLE TOY WITH ELEVATING BODY

[75] Inventor: Neil Tilbor, Medford, N.J.

[73] Assignee: Tyco Investment Corp, Wilmington, Del.

[21] Appl. No.: 923,708

[22] Filed: Jul. 31, 1992

[51] Int. Cl.[5] ..... A63H 30/00; A63H 17/26

[52] U.S. Cl. ..... 446/454; 446/466; 446/470; 446/130

[58] Field of Search ..... 446/454, 456, 466, 470, 446/471, 129, 130, 137, 139

[56] References Cited

U.S. PATENT DOCUMENTS

| | | | |
|---|---|---|---|
| 3,162,978 | 12/1964 | Balthazor . | |
| 3,237,345 | 3/1966 | Feliziani | 446/130 |
| 4,007,646 | 2/1977 | DeJonge | 446/454 X |
| 4,089,342 | 5/1978 | Westerman . | |
| 4,349,984 | 9/1982 | Goldfarb et al. | 446/139 X |
| 4,435,916 | 3/1984 | Iwao et al. . | |
| 4,457,099 | 7/1984 | Kozuka et al. | 446/466 X |
| 4,480,401 | 11/1984 | Matsushiro . | |
| 4,601,519 | 7/1986 | D'Andrade . | |
| 4,655,727 | 4/1987 | Swisher et al. . | |
| 4,693,696 | 9/1987 | Buck . | |
| 4,696,655 | 9/1987 | D'Andrade et al. . | |
| 4,702,720 | 10/1987 | Konta et al. . | |
| 4,737,135 | 4/1988 | Johnson et al. . | |
| 4,773,889 | 9/1988 | Rosenwinkel et al. . | |
| 4,776,415 | 10/1988 | Brice . | |
| 4,822,316 | 4/1989 | Shaffer et al. | 446/466 |
| 4,850,929 | 7/1989 | Genevey . | |
| 4,850,931 | 7/1989 | Auer . | |
| 4,892,503 | 1/1990 | Kumazawa . | |
| 4,911,669 | 3/1990 | Parker . | |
| 4,993,983 | 2/1991 | Kurita et al. . | |
| 5,135,427 | 8/1992 | Suto et al. | 446/456 X |

FOREIGN PATENT DOCUMENTS

| | | | |
|---|---|---|---|
| 2155343 | 9/1985 | United Kingdom | 446/470 |

OTHER PUBLICATIONS 4 original Polaroid photographs of a Batmobile TM toy vehicle, marked Kenner Products, 1992.

*Primary Examiner*—David N. Muir

*Attorney, Agent, or Firm*—Panitch, Schwarze, Jacobs & Nadel

[57] ABSTRACT

A remotely controlled vehicle toy is provided with an internal actuator to temporarily secure the vehicle body close to the chassis, thereby substantially or essentially covering lateral sides and an upper side of the vehicle beneath the body, and to remotely release the body from the secured position, permitting the body to move to an elevated position spaced above the chassis thereby permitting off-road movement and revealing internal automotive detailing on the remaining portion of the vehicle previously covered and hidden by the body.

19 Claims, 5 Drawing Sheets

VEHICLE TOY WITH ELEVATING BODY

FIELD OF THE INVENTION

The present invention relates to vehicle toys and, in particular, to remotely controlled vehicle toys having unusual action capabilities.

BACKGROUND OF THE INVENTION

Vehicle toys are well known. Remotely controlled, in particular, radio-controlled vehicles have come to constitute a significant specialty toy market.

Manufacturers in this market attempt to duplicate well known vehicles as well as the latest in automotive developments, including specialty entertainment vehicles. In addition, manufacturers constantly seek new ways and features to add innovative action to such toys to make such vehicles more versatile and/or entertaining.

SUMMARY OF THE INVENTION

In one aspect, the invention is a remotely controlled vehicle toy comprising: a chassis; a separate vehicle body; at least one motor driving at least one vehicle propelling wheel supported from the chassis; and means for securing the body proximal to the chassis and for selectively elevating the body away from the chassis by remote control.

Another aspect of the invention is a remotely controlled vehicle toy comprising: a chassis; at least one motor driving at least one vehicle propelling wheel supported from the chassis; a vehicle body positioned over the chassis; a catch one of the body and the chassis; an actuator including a displaceable release member movably secured with a remaining one of the body and the chassis to receive and engage the catch and to hold the body positioned proximal to the chassis through the catch; a controller responsive to control signals received from a source remote to the vehicle and coupled with the actuator to at least control operation of the actuator; and a bias member positioned to elevate the body from the chassis when the actuator is operated and the catch is released to thereby expose a greater portion of the vehicle beneath the body to view.

Another aspect of the invention is a remotely controlled vehicle toy comprising: a chassis; at least one motor driving at least one vehicle propelling wheel supported from the chassis; a separate vehicle body positioned over the chassis; a coupling on one of the body and the chassis; and an actuator including a displaceable member movably secured with a remaining one of the body and the chassis and positioned to receive and engage the coupling and to hold the body positioned proximal to the chassis through the coupling; and a controller configured to operate the actuator remotely from the vehicle and elevate the body away from the chassis by remote control.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings, which are diagrammatic.

DETAILED DESCRIPTION OF PREFERRED EMBODIMENTS

Figure 1:
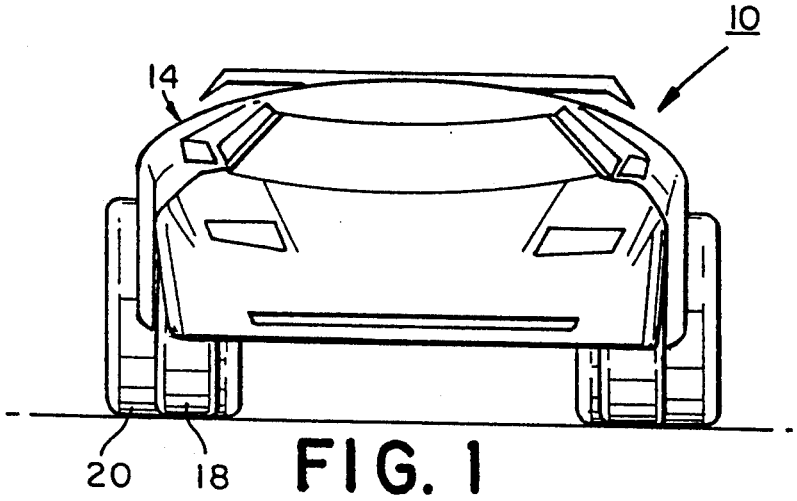
FIG. 1 is a front elevation of a first embodiment vehicle of the invention.

In the drawings, like numerals are used to indicate like elements throughout. A preferred vehicle toy taught through the present invention is indicated generally at 10 in FIGS. 1 through 5. Vehicle 10 preferably comprises a chassis, indicated generally at 12, and a separate preferably aerodynamically-shaped automobile style vehicle body, indicated generally at 14, positioned over the chassis. Except for a lower rear side portion of the drive housing 16, which is seen in FIG. 2 below the rear end of the body 14, and very minor portions of lateral sides of the chassis 12, which can be seen in narrow spaces provided between the front and rear wheels 18 and 20 and the front and rear wheel wells 19 and 21, respectively, of the body 14, essentially all of the lateral sides, the front side and the top side of the chassis 12, are covered and hidden from view by the body 14 in FIGS. 1–3. The body is preferably essentially opaque but if the windows are clear, the body may be provided with an opaque cockpit concealing the underlying upper surface of chassis 14, if desired.

Figure 4:
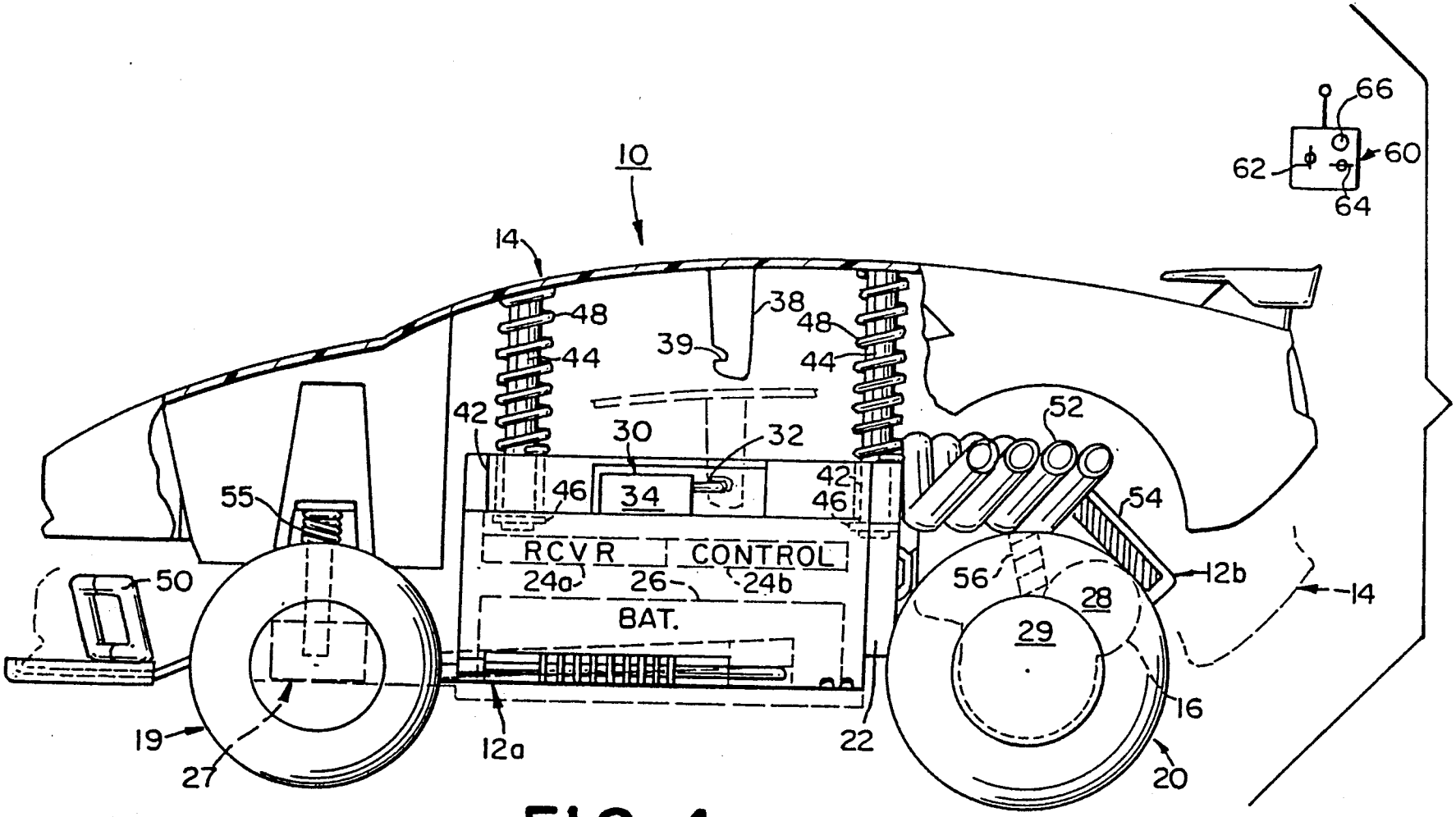
FIG. 4 is a side elevation of the vehicle of FIGS. 1–3 with the vehicle body partially broken away and elevated from the chassis.
Figure 5:
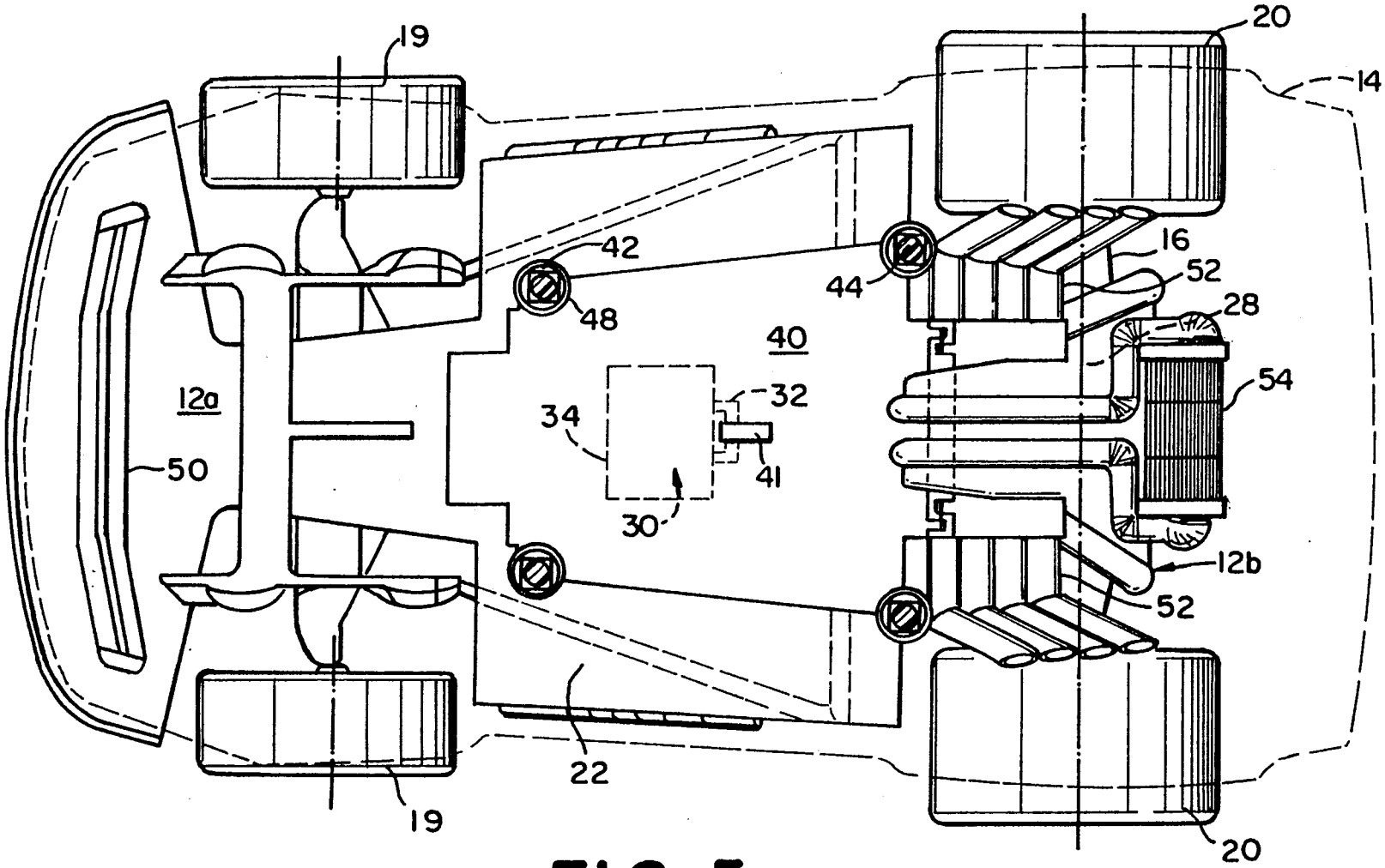
FIG. 5 is a top plan view of the chassis depicting the outline of the body in phantom.

Referring to FIG. 4, preferably the chassis 12 is a conventional off-road, radio control toy vehicle chassis which includes a front portion **12*a* pivotally coupled with a rear motor portion 12*b* in a conventional manner, for example, like that disclosed in U.S. Pat. No. 5,135,427, which is incorporated by reference herein in its entirety. Centrally located in the vehicle and forming a rear part of the front chassis portion 12***a*, is a housing 22, which contains the electrical circuitry of the vehicle 10, preferably mounted on a PC board. The electrical circuitry preferably includes a radio receiver portion and a controller portion, indicated in phantom block form at 24*a*, 24*b*, respectively. The housing 22 further preferably contains a power source, indicated in phantom block diagram form at 26, which is preferably a removable, rechargeable battery pack supplying the vehicle's power.

The drive housing 16 essentially defines the rear portion 12*b* of the chassis 12 and is preferably pivotally coupled with the electrical housing 22 on the front portion of the chassis in the manner disclosed in U.S. Pat. No. 5,135,427. The drive housing 16 contains at least one conventional remote control vehicle reversible electrical motor 28 coupled to at least one of the rear wheels 20 by a suitable gear train 29. A pair of such motors may be provided to drive each of the rear wheels independently or a single motor or a pair of motors geared together to simultaneously drive both rear wheels. A separate steering actuator 27, indicated in phantom block form, is provided on the front chassis portion 12 and through a conventional lineage (not depicted) pivots the front wheels 19 to steer the vehicle 10 in either lateral direction. As has been described thus far, the chassis 12 and its components are entirely conventional based on well known, existing radio controlled vehicle designs.

Figure 2:
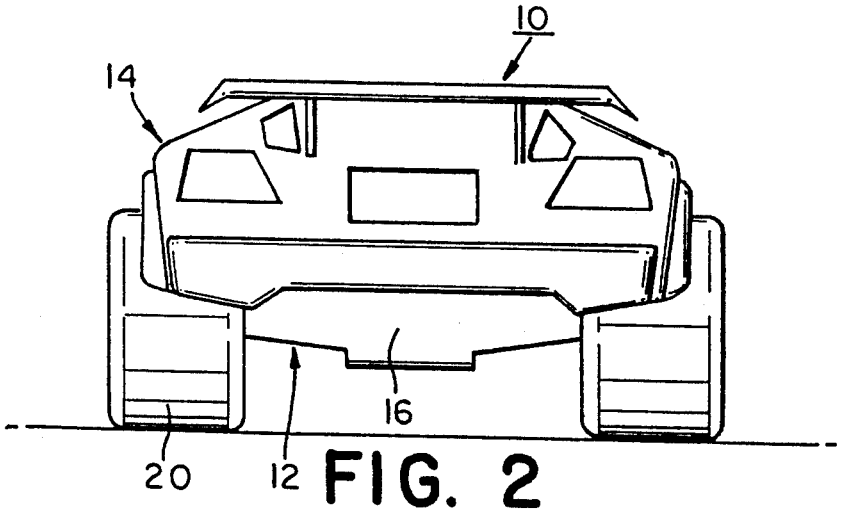
FIG. 2 is a rear elevation of the vehicle of FIG. 1.
Figure 3:
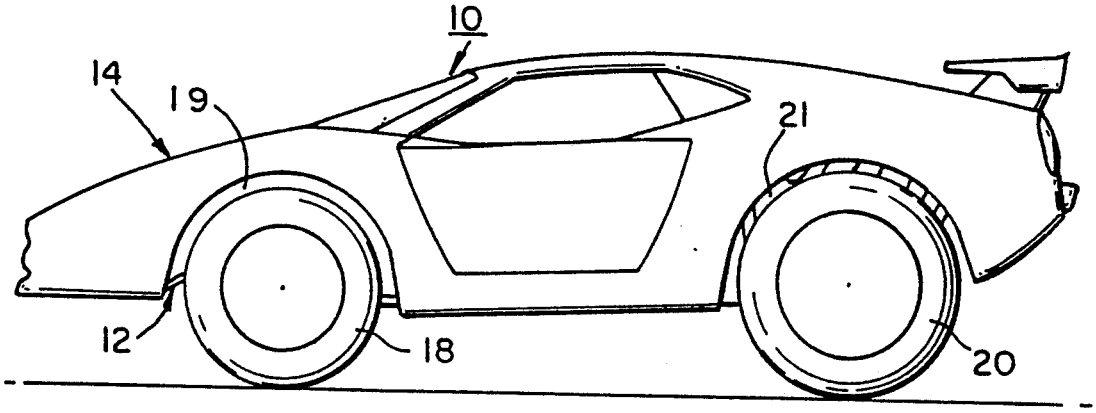
FIG. 3 is a side elevation of the Vehicle of FIGS. 1 and 2.

Still referring to FIG. 4, there is depicted the means by which the body 14 is secured proximal to the chassis 12 in the configuration shown in FIGS. 1 through 3 and in phantom in FIG. 4, which further permits selective elevation of the body away from the chassis to the position shown in solid in FIG. 4, by remote control. An actuator, indicated generally at 30, is secured with the chassis by being fixedly mounted to the top of the electrical housing 22. Preferably, the actuator includes a spring loaded displacable release member 32 which can be pushed into a main body 34 housing the remaining components of the actuator, against the spring bias, or drawn into the body 34 against the bias when the actuator is operated by supplying it with an electric current. Member 32 is thus movably secured to the chassis through the remainder 34 of the actuator 30. The controller portion 24*b* of the electrical circuitry is configured to respond to a control signal received from a radio source remote to the vehicle 10, such as from a radio transmission remote controller depicted diagrammatically at 60. The controller portion 24*b* is coupled electrically with the actuator 30 to permit the controller portion 24*b* of the circuitry to control operation of the actuator 30.

The body 14 is releasably secured to the chassis 12 through the actuator 30 by means of a coupling in the form of a tab catch The catch 39 is provided by a notch in a tab 38 fixedly secured with and extending downwardly from the inner side of the body 14. The tab catch 38/39, actuator 30 and its displacable member 32 are positioned such that the displacable member 32 engages with the notch 39 of the tab 38 when the body 12 is positioned proximal the chassis as shown in FIGS. 1 through 3. This engagement is shown in phantom in FIG. 4.

A separate top plate 40 is preferably mounted over the electrical housing 22 and secured thereto at its corners by tubular, column-like structures 42. An opening 41 through plate 40 receives tab 38. Top plate 40 may be part of a generally U-shaped inner cover which can be formed with certain automotive detailing and slipped over a conventional remote control vehicle chassis lacking such detailing. The column-like structures 42 have central vertical passageways which pass through the top plate 40 and into the electrical housing 22. An equal plurality of post members 44 are provided projecting vertically downwardly from the inner side of the body 14 towards the chassis 12. The members 44 are received in the plurality of column-like structures in a telescopic mating relation. The distal ends of the post members 44 are preferably retained below the top plate 40, preferably within the electrical housing 22, and are movably secured with the housing 22, by suitable means such as washers 46, split ring fasteners or the like slipped into circular grooves provided at the ends of the post members 44, or in any other conventional manner. Preferably, an equal plurality of bias members in the form of compression coil springs 48 are provided, each associated with one of the post members 44, each preferably centrally receiving a separate one of the vertical post members 44, so as to be retained on the post member 44 between the top plate 40 and the facing inner side of the body 14. Springs 48 are positioned to elevate the body 14 uniformly vertically away from the chassis 12 when the notch 39 is released by the displacable member 32 after the actuator 30 is operated. The springs 48 also maintain the body 14 elevated away from the chassis 12, preferably to the limits of travel of the post members 44. Preferably, the post members 44 and tubular structures 42 cooperate to guide the body 14 straight up to the elevated position.

Preferably, the chassis 12 is further provided with automotive detailing which only becomes visible after the body 14 has been released and moved to its elevated position. These could be frame, suspension, motor and/or drive train details. The detailing may be three dimensional (functional or non-functional) or merely surface ornamentation provided to simulate such functional elements. For example, the chassis 12 may be provided with such detail as the hidden crash bumper 50 provided proximal a front end of the chassis 12, a bank of header pipes, indicated generally at 52, an external fluid cooler (oil, transmission, or both) indicated generally at 54, front and rear operating suspension springs 55, 56 etc. Each of these detail elements is either completely hidden or essentially hidden from view by the body 14 when the body 14 is secured closely to the chassis 12 as indicated in FIGS. 1 through 3.

This arrangement permits the use of an off-road vehicle chassis having oversized tires with a conventional vehicle body, preferably that of a sports car which is among the vehicles least likely to possess off-road capability. It can also permit more versatile, off-the-road operation of the vehicle 10. Preferably, the body 14 is configured so as to cover and hide, together with the wheels, at least most, if not essentially all, of the two lateral, the front and the top side of the chassis from view when the tab catch 38/39 is engaged with the release member 32.

Propulsion and steering action of the vehicle 10 may be entirely conventional like that of any number of arrangements previously used in radio controlled, electric toy vehicles known to those of ordinary skill in this art. The remote controller 60 is also conventional and compatible with the controller portion 24*b* of the vehicle electronics. The controller 60 may have a pair of toggle or slide control members 62, 64 to generate signals controlling operation of the motor(s) 28 and steering actuator 27. The remote controller 60 is modified from existing controllers to the extent that it includes a switch 66 and circuitry coupled with the switch and configured to generate and transmit a control signal to control operation of the actuator 30. For example, a separate channel or frequency band can be used to provide a control signal from remote controller 60 to controller portion **24*b* to operate the actuator 30, which signal is continuous as long as switch 66 is depressed. The controller portion 24*b* of the electrical circuitry is similarly modified to recognize and respond to such signal from the remote controller 60 directing operation of actuator 30 to disengage member 32 from the catch 39 and release the body 14 from its position close to the underlying chassis 12. The actuator 30 is conventionally designed to draw the displacable release member 32 into the main body 34 and disengage that member from the catch 39** when operated.

While the essential features of the invention have been disclosed and described above with respect to a preferred embodiment, one of ordinary skill will appreciate that the invention may assume any of a wide variety of configurations.

For example, in the embodiment of FIGS. 1–5, post members 44 and tubular structures 42 may be entirely eliminated and the coil springs 48 secured at their extreme ends to both the chassis 12 and body 14 and used to movably secure the body with the chassis themselves. Any number and variety of bias members may be employed instead of the coil springs disclosed. Other types of conventional springs such as leaf and torsion springs might be used, elastomeric member(s) or other types of mechanical linkages or even a fluid or magnetic coupling/linkage may be employed to both move the body 14 away from the chassis 12 and to maintain the body 14 at an elevated position spaced from yet secured with the chassis.

Figure 6:
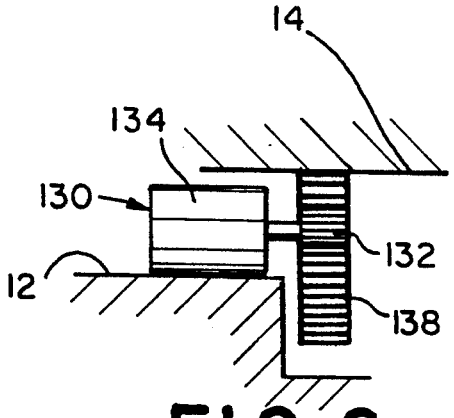
FIG. 6 is a second embodiment actuator and coupling for securing the vehicle body with and controllably elevating the body over the vehicle chassis.

For example, FIG. 6 depicts diagrammatically an electric motor actuator 130 with rotary drive member 132 in the form of a pinion and a rack 138 having an upper end coupled to, preferably fixedly secured with a vehicle body 14 and constituting the coupling between the body 14 and the chassis 12 through the actuator 130. In the nominal starting position, the rack 138 would extend downwardly past the pinion 132. Mechanical advantage provided by the inertia of the actuator motor 134 holds the rack 138 in position. When energized, the actuator 130 would drive the rack 138 upwardly and hold the rack 138 in the elevated position, again by mechanical advantage. The actuator 130 and rack 138 can be designed so as to permit the user to overcome the mechanical advantage by simply pressing the body 14 firmly towards the chassis 12 and causing the actuator motor 134 to run in a reverse direction. Other strictly mechanical actuators and/or linkages and/or couplings may be employed. For example, instead of a rack and pinion, a pinion and gear, a worm and gear or driven screw and female threaded member might be employed.

Figure 7:
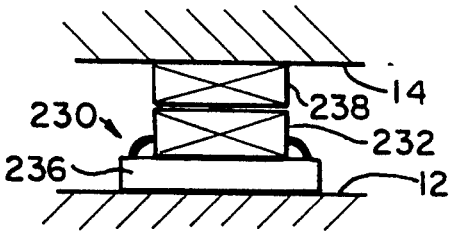
FIG. 7 is a third embodiment actuator and coupling for securing the vehicle body with and controllably elevating the body over the vehicle chassis.

FIG. 7 depicts diagrammatically another type of actuator and coupling. The actuator 230 is preferably supplied with an electromagnet 232, while a permanent magnet 238 is connected, preferably fixedly secured with the inner facing side of the vehicle body. Current is maintained through the electromagnet 232 in a first direction which initially attracts the permanent magnet 238. When a release signal is received, the actuator 230 reverses the flow of current through the electromagnet 232, thereby repelling the permanent magnet 238 and elevating the body 14 from the chassis 12.

Figure 8:
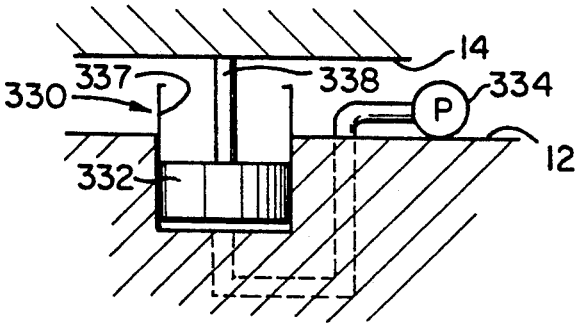
FIG. 8 is a fourth embodiment actuator and coupling for securing the vehicle body with and controllably elevating the body over the vehicle chassis.

FIG. 8 depicts diagrammatically yet another type of actuator 330 including a cylinder 337 with moveable piston 332 and a control member 334 in the form of a pump (depicted) or valve coupling the cylinder to a pressurized fluid source. A member 338 couples the piston 332 with the vehicle body 14. The piston 332 may be moved by positive or negative fluid pressure. Another type of fluid operated actuator may be an inflatable bladder bearing or moving a latch member into engagement with a catch. The actuator would be operated by inflating or deflating the bladder, as appropriate.

Figure 9:
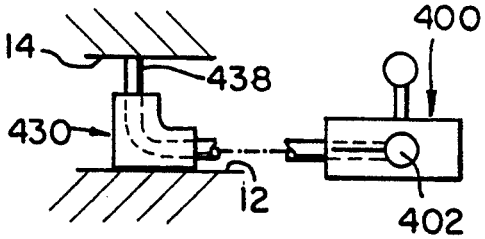
FIG. 9 is a fifth embodiment actuator and coupling for securing the vehicle body with and controllably elevating the body over the vehicle chassis.

FIG. 9 depicts diagrammatically an entirely mechanical actuator in the form of a holder 430 secured, for example, to the chassis, guiding a flexible wire 438 coupling the chassis 12 with the body 14. One end of the wire 438 is coupled to and preferably fixedly secured with the body 14 while the remaining end of the wire extends from the vehicle 10 to a remotely located hand controller 400, also provided for steering and/or propulsion control of the vehicle. The wire 438 appropriate member 402 on the controller 400, which is coupled with the remaining end of the wire 438. The wire 438 could be used to elevate, maintain and then lower the body 14 with respect to the chassis 12 at any time it is desired.

Figure 10:
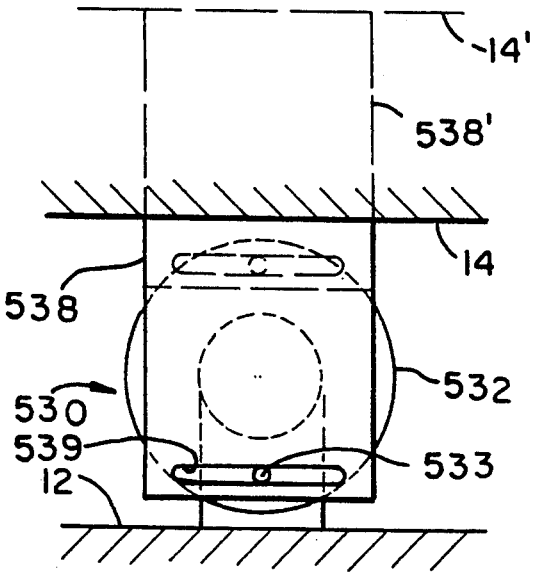
FIG. 10 is a sixth embodiment actuator and coupling for securing the vehicle body with and controllably elevating the body over the vehicle chassis.
Figure 11:
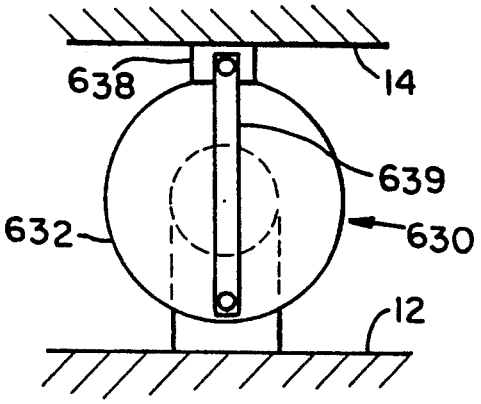
FIG. 11 is a seventh embodiment actuator and coupling for securing the vehicle body with and controllably elevating the body over the vehicle chassis.
Figure 12:
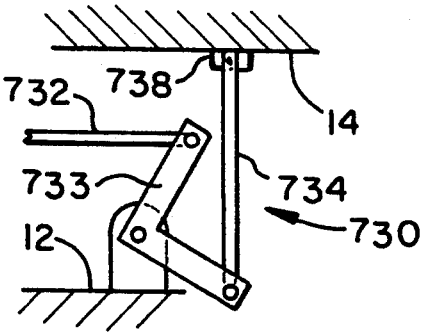
FIG. 12 is an eighth embodiment actuator and coupling for securing the vehicle body with and controllably elevating the body over the vehicle chassis.

FIGS. 10–12 depict various other coupling and rotary drive displacable/displaced member combinations which can be controllably driven by a coupled electric motor actuator. In FIG. 10, an electrically operable actuator 530 includes a rotary displacable member in the form of a wheel 532 fixedly mounting a pin 533. Pin 533 is coupled with the vehicle body 14 by means of a tab 538 descending from the body 14 and having an elongated horizontal slot 539 receiving the pin 533. As the wheel 532 is rotated by a prime mover of the actuator, such as an electric motor, which is not depicted but which would be fixedly secured with the chassis 12, pin 533 traverses a circular arc. The pin 533 drives the tab 538 upwardly, holding it and the body at elevated positions, indicated in phantom at 538' and 14'. If energized for a longer period of time, if a variable control is provided, or a second time, if a pulse control is provided, the wheel 532 rotates back to its original position drawing the body 14 back to its original position closely adjoining the chassis 12. Preferably, the tab 538 telescopes in a vertical slot provided in the chasis 12.

FIG. 11 depicts an actuator 630 driving a rotary displacable member in the form of a wheel 632 and a coupling between the body 14 of the vehicle and the rotary member 632 in the form of a tab 638 and a link 639 pivotally coupled with the tab 638 and the wheel 632. Operation of this seventh embodiment actuator/coupling would be the same as the sixth embodiment actuator/coupling combination described above, although supplemental means may be needed, such as telescoping members (not depicted) between the chassis 12 and body 14, to guide the body 14 up and down in a desired orientation.

In FIG. 12, an eighth embodiment actuator 730 is indicated including a displacable member in the form of a link 732 pivotally coupled with one arm of a bellcrank 733, itself pivotally coupled with the chassis 12 and a second link 734 pivotally coupled with a remaining arm of the bellcrank 733 and the vehicle body 14 through a tab 738. The remainder of the actuator 730 coupled with a remaining end of link 732 may provide either a linear or rotary drive motion to that end of the link 732 to operate the bellcrank 733. One of ordinary skill in the art will appreciate that through suitable linkages, linear motions of actuators can be converted into rotary motions and vice versa.

Figure 13:
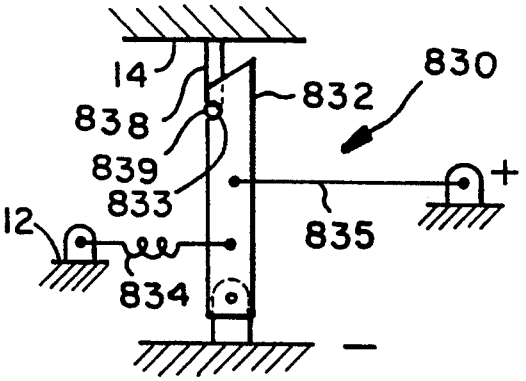
FIG. 13 is a ninth embodiment actuator an coupling for releasably securing the vehicle body with the chassis and releasing the body by remote control.

FIG. 13 depicts yet another electro-mechanical actuator indicated generally at 830, including a pivotally supported displaceable member 832 having a notch 833 engaging with a catch 839 formed by a crossbar portion of a generally U-shaped tab member 838 fixedly secured with an inner side of a body 14. A member 834 biases the displacable member 832 against the tab 838 engaging notch 833 with catch 839. An electro-responsive member 835 couples the pivotally supported member 832 with the chassis 12 in a manner in which the electro-responsive member 835 will disengage notch 833 from catch 839, thereby releasing the body 14 from the chassis when energized. The electro-responsive member 835 may be a Nitinol TM wire or piezoelectric member, each of which will contract in at least one dimension in response to an electric current passed therethrough.

Figure 14:
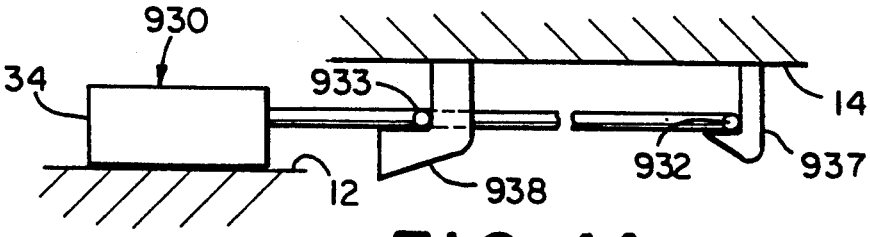
FIG. 14 is a tenth embodiment actuator and coupling for securing the vehicle body with and controllably elevating the body over the vehicle chassis.

Other possible variations on the main invention include elevating the body in stages or elevating one end or side of the body before elevating a remaining end or side. For example, FIG. 14 depicts an electrically operable actuator 930 having coupled first and second displacable release members 932 and 933. The first release member 932 may be engaged with a first or primary tab catch 937 fixedly secured to a one side or end of the inner side of the vehicle body 14 while the second displacable release member 933 simultaneously, engaged with a second or secondary tab catch 938, is fixedly secured with an opposing part of the same vehicle body. When initially actuated, the actuator 930 draws the interconnected release members 932 and 933 towards the actuator housing 934. The release member 932 first disengages from the first catch 937, freeing that end side of the body to rise, preferably under the effect of one or more bias member (not depicted). For example, the rear end of the vehicle body might elevate away from the rear end of the chassis and remain generally above the front end of the body. By energizing the actuator 930 for a longer period of time or a second time, depending upon how it is configured, the secondary release member 933 disengages from the secondary catch 938, thereby releasing the opposing end/side of the body 14 to elevate under the effect of the bias member(s) to approximately the same height as the one end/side of the body 14.

The vehicle body 14 can be elevated in stages in other ways. For example, a single actuator might be used to elevate or permit elevation of one end of the body followed by a remaining end of the body through the use of one or more bias members configured and positioned to first elevate one end of the body. For example, the one end of the vehicle body may be released initially from a stationary catch by movement of the single actuator yet remain coupled through the actuator. Further operation of the actuator would then permit disengagement of the actuator from the coupling to permit elevation of the remainder of the body through the one or more bias members. Similarly, a multistage elevation procedure could be provided by means of an actuator and an appropriate linkage. For example, the actuator may be asymmetrically positioned or have a displacable member asymmetrically positioned to initially elevate one end of the vehicle body and, when that end of the body has completed its permitted path of travel, to continue the elevation of the remaining end of the body. Also, the vehicle 10 and the remote controller 60 could be configured in a manner like that in FIGS. 6 through 9 to be reversible or like that 10–12 to vary the vehicle height as desired by selectively and variably controlling the length of time the actuator is operated.

One or ordinary skill will appreciate that it will be possible and acceptable to mix and match different components and connectors to achieve the same result. For example, although an electrical motor prime mover has been suggested specifically with respect to the first and second embodiments, one or ordinary skill will appreciate that other conventional prime movers including hydraulic, pneumatic and electromagnetic movers can be freely interchanged as could many of the displaceable members and couplings. One of ordinary skill will further appreciate that with wired or equivalent tether control of the vehicle from a remotely located handset it is possible to locate the prime mover in the remote handset and couple it with the appropriately configured displaceable member(s) within the vehicle. As used herein and hereafter, remote control, remotely controlled, remote controller and like terms are intended to broadly encompass both wire and wireless controls as exemplified but not limited by the various embodiments shown and modifications thereto discussed herein. Further, it is always possible to complicate the drives illustrated and/or suggested by adding more members to the train or linkages disclosed. Also, one or ordinary skill will appreciate that both a coupling and a prime mover be fixedly secured together on either the body or the chassis and the displaceable member be movably secured to the remaining one of the body of the chassis and positioned such that the actuator can physically displace the displaceable member causing disengagement between it and the coupling.

Certain practical benefits are also provided by the design. For example, allowing the body 14 to be raised above the chassis: increases overall ground clearance for use of the vehicle on rough surfaces, increases the wheel to wheel well clearance to permit greater suspension travel for better performance on rough or off-road surfaces and raises the center of gravity of the vehicle. The latter step increases front to rear end lateral weight transfer under acceleration, deceleration and turning, and enhances traction and control on soft, unpaved surfaces for better performance. Conversely, lower body position enhances on-road performance by lowering the center of gravity for more rapid acceleration, deceleration and turning on the better traction surface.

Furthermore, while the detailing revealed by the preferred embodiment of FIGS. 1–5 includes functional suspension elements in the form of coil springs and non-functional, three-dimensional surface detailing on the chassis itself, the chassis may be equipped with its own cover, which is hidden inside the body 14 until the body 14 is released and which embodies or hears the detail or indeed, even a separate, smaller vehicle outer body, which is concealed within the outer releasable body. In the latter case it may be desirable to fully release and discard the main outer body by the remote control action to totally convert the vehicle from an initial on-road configuration to a totally different appearing off-road configuration.

While the preferred embodiment of the invention has been described and numerous modifications thereto suggested, one of ordinary skill will appreciate yet other modifications, arrangements, structures and modes of operation would be possible to achieve the ultimate purpose of remotely elevating the body of the vehicle from its chassis as desired while the vehicle is in operation. The foregoing examples are meant to be exemplative and not limiting. It is to be understood, therefore, that the invention is not limited to the particular embodiments disclosed or suggested, but is intended to cover any modifications which are within the scope and spirit of the invention, as defined by the appended claims.

I claim:

1. A remotely controlled vehicle toy comprising:

a chassis;

at least one motor driving at least one vehicle propelling wheel supported from the chassis;

a vehicle body positioned over the chassis;

a catch on one of the body and the chassis;

an actuator including a displacable member, the member being movably secured with a remaining one of the body and the chassis, the member engaging the catch and holding the body positioned proximal to the chassis through the catch;

a controller responsive to control signals received from a source remote to the vehicle and coupled with the actuator to at least control operation of the actuator; and a bias member positioned to elevate the body from the chassis when the actuator is operated and the catch is released and to thereby expose a greater portion of the vehicle beneath the body to view.

2. The vehicle toy of claim 1 wherein at least part of the body is coupled in telescoping relation with the chassis.

3. The vehicle toy of claim 1 further comprising:

a plurality of members projecting vertically downward from an inner side of the body towards the chassis; and a plurality of structures on the chassis, each structure being in telescopic mating relation with a separate one of the first plurality of members.

4. The vehicle toy of claim 3 wherein the members and mating structures continue to secure the body with the chassis after elevation of the body from the chassis.

5. The vehicle toy of claim 3 wherein the bias member is positioned proximal to one of the plurality of projecting members and further comprising an additional bias member associated with at least one other projecting member of the plurality.

6. The vehicle toy of claim 1 wherein the bias member is a coil spring.

7. The vehicle toy of claim 1 wherein the body is configured so as to essentially cover and hide from view at least lateral sides of the vehicle beneath the body when the catch is engaged with the displacable member and wherein at least part of one lateral side of the vehicle beneath the body has automotive surface detailing which becomes visible to view only upon release of the catch from the displacable member and movement of the body away from the chassis.

8. The vehicle toy of claim 1 wherein the bias member secures the body to the chassis after the catch is released from the displacable member.

9. The vehicle toy of claim 1 further comprising a secondary catch on one of the body and the chassis and a secondary displacable release member on a remaining one of the body and the chassis, the secondary catch and secondary displacable release member being configured to hold at least one end of the body proximal the chassis after initial disengagement of the catch from the displacable member until a remaining end of the body has moved away from the chassis following disengagement of the displacable member from the catch.

10. The vehicle toy of claim 9 wherein the secondary displacable member is coupled with the actuator so as to disengage from the secondary catch only after the catch is released from the displacable member.

11. A remotely controlled vehicle toy comprising:

a chassis;

at least one motor driving at least one vehicle propelling wheel supported from the chassis;

a coupling on one of the body and the chassis;

an actuator including a displacable member movably secured with a remaining one of the body and the chassis and positioned to receive and engage the coupling and to hold the body in a position proximal to the chassis through the coupling, the actuator and the coupling cooperating to elevate the body from the position proximal to the chassis during at least one mode of operation of the actuator and to thereafter maintain the body elevated over the chassis during further translational movement of the vehicle toy by the one motor; and a controller configured to operate the actuator remotely from the vehicle to selectively elevate the body away from the chassis by remote control.

12. A vehicle toy comprising:

a chassis;

a separate vehicle body;

at least one motor driving at least one vehicle propelling wheel supported from the chassis;

an independently operable actuator secured to one of the body and chassis, the actuator including a displaceable member; and a coupling securing a remaining one of the body and chassis with the one body or chassis through the actuator, the coupling including a catch on the remaining one of the body and the chassis, the displaceable member being positioned to receive and engage the catch and to hold the body positioned proximal to the chassis until the actuator is operated; and a bias member positioned to elevate the body from the chassis when the actuator is actuated and the catch disengages from the displaceable member and to thereafter maintain the body elevated over the chassis until the separate body is selectively lowered to the position proximal to the chassis by human intervention.

13. The vehicle toy of claim 12 further comprising a controller coupled with the actuator and configured to permit selective operation of the actuator remotely from the vehicle.

14. A vehicle toy comprising:

a chassis;

a separate vehicle body;

at least one motor driving at least one vehicle propelling wheel supported from the chassis;

an independently operable actuator secured to one of the body and chassis; and a coupling securing a remaining one of the body and chassis with the one body or chassis through the actuator, the actuator and the coupling cooperating to elevate the body from a position proximal the chassis at least generally vertically away from the chassis when the actuator is operated in at least one mode of operation and to thereafter maintain the body elevated over the chassis until the body is selectively lowered to the position proximal the chassis by human intervention.

15. The vehicle toy of claim 14 further comprising a controller coupled with the actuator and configured to permit selective operation of the actuator remotely from the vehicle.

16. The vehicle toy of claim 14 wherein the actuator comprises a rotating drive member and wherein the coupling comprises a driven member displaced by rotation of the drive member.

17. The vehicle toy of claim 14 wherein the actuator comprises an electromagnet and the coupling comprises a permanent magnet.

18. The vehicle toy of claim 14 wherein the actuator comprises a fluid operated piston.

19. The vehicle toy of claim 14 wherein the actuator comprises a member extending from the vehicle to a remotely located hand controller.

* * * * *